United States Patent [19]

Proctor et al.

[11] 4,378,738

[45] Apr. 5, 1983

[54] ELECTROMAGNETIC AND ELECTROSTATIC INSENSITIVE BLASTING CAPS, SQUIBS AND DETONATORS

[76] Inventors: Paul W. Proctor, Rte. 2, Box 60 Kathy La., White Plains, Md. 20695; Robert L. Dow, Rte. 5 Box 415, La Plata, Md. 20646

[21] Appl. No.: 105,467

[22] Filed: Dec. 19, 1979

[51] Int. Cl.[3] ..... F42C 11/00

[52] U.S. Cl. ..... 102/202.7; 102/202.9; 102/202.12

[58] Field of Search ..... 102/202.7, 202.9, 202.12

[56] References Cited

U.S. PATENT DOCUMENTS

| | | | |
|---|---|---|---|
| 2,821,139 | 1/1958 | Apstein et al. . | |
| 3,018,733 | 1/1962 | Johnson . | |
| 3,043,223 | 7/1962 | Clark . | |
| 3,101,669 | 8/1963 | Gatley et al. | 102/202.9 |
| 3,272,127 | 9/1966 | Betts et al. . | |
| 3,274,937 | 9/1966 | Kyle . | |
| 3,324,793 | 6/1967 | Thomas | 102/202.7 |
| 3,342,133 | 9/1967 | Strom et al. | 102/202.7 |
| 3,343,491 | 9/1967 | Peters, Jr. . | |
| 3,682,096 | 8/1972 | Ludke et al. | 102/202.9 |
| 3,906,858 | 9/1975 | Craig et al. | 102/202.9 |
| 3,985,078 | 10/1976 | Hart et al. | 102/202.7 X |
| 4,220,088 | 9/1980 | Kimura et al. | 102/202.7 X |

OTHER PUBLICATIONS

*Eng. Design Handbook, Explosive Series, Explosive Trains*, AMCP 706-179, pp. G2-3 (1974).

*Aerospace Ordinance Handbook*, Pollard et al., Prentice-Hall, Inc., pp. 435-439.

*Primary Examiner*—Peter A. Nelson

[57] ABSTRACT

A broad band attenuator having a ferrite material for absorption of stray electromagnetic radiation minimizes the unintentional initiation of electroexplosive devices. In one embodiment, each input lead of a detonator passes through a ferrite choke core in contact with the metallic casing that houses the detonator. A printed circuit tape between the input leads and the casing provides electrostatic protection, and heat generated by the ferrite choke core is removed by radiation from the metal casing.

8 Claims, 3 Drawing Figures

ELECTROMAGNETIC AND ELECTROSTATIC INSENSITIVE BLASTING CAPS, SQUIBS AND DETONATORS

STATEMENT OF GOVERNMENT INTEREST

The invention described herein may be manufactured by or for the Government of the United States of America for governmental purposes without the payment of any royalties thereon or therefor.

BACKGROUND OF THE INVENTION

The present invention relates to electroexplosive devices (EEDs) such as detonators, blasting caps and squibs, and more particularly to a method and apparatus for desensitizing EEDs to electromagnetic radiation and electrostatic charges, thus preventing the premature or inadvertent detonation thereof. Squibs are classified as EED's, even though they may contain a pyrotechnic composition instead of a low explosive. Regardless of whether a low explosive or a pyrotechnic composition is used, the composition is energetic and the function is the same, i.e., start of an explosive train.

A typical EED has a fine-gauge bridgewire imbedded in a chemical compound that explodes when brought to a high temperature, the bridgewire being heated by passing therethrough a relatively small amount of direct current. Because so little energy is required to ignite an EED, it is very sensitive to high frequency radiation which may be readily induced into the input leads and then into the bridgewire. EEDs are also known to be sensitive to transient or spurious signals, stray currents, and static charges.

Various methods have been used to alleviate the problem of misfiring caused by electromagnetic radiation. Prior art systems have included RF traps with inductive and capacitive components, spark gaps, and bypass circuits using diode and capacitor combinations. However, filters having a plurality of discrete components are relatively expensive, and many of the prior RF attenuation systems cannot be readily applied to existing EEDs. In addition, prior attenuators have generally been unsuitable for commercial production because of the costs involved in producing the units.

SUMMARY OF THE INVENTION

Accordingly, the present invention overcomes many of the above problems by providing a relatively low cost, broad band, RF attenuator and an electrostatic attenuator, each being a single component, that are compatible with existing electroexplosive devices, and are capable of being used on high-speed automated production.

In one embodiment of this invention a cylindrical core formed of a lossy ferrite material is placed around the input leads to the bridgewire of an EED so that the ferrite is in mechanical contact with the metallic casing. Partial grounding of the leads through a printed circuit tape provides electrostatic protection by shunting any static charge away from the bridgewire.

The known property of ferrite to absorb or attenuate high frequency electromagnetic radiation provides a broad band attenuator that has neglibible effect on the normal DC firing signal to the EED. The intimate contact between the ferrite choke and the EED casing provides an efficient heat transfer means to dissipate the heat generated when the ferrite material attenuates RF.

OBJECTS OF THE INVENTION

It is therefore an object of the present invention to provide a broad band electromagnetic radiation attenuator for use with electroexplosive devices that requires a minimum of discrete components.

Another object of this invention is to provide RF attenuation by means of a ferrite material surrounding EED bridgewire input leads.

Yet another object of this invention is to provide a relatively low cost electromagnetic and electrostatic attenuators that are configured so as to be capable of high-speed automated production.

Still another object of the present invention is to provide an attenuator that is compatible with existing EEDs.

BRIEF DESCRIPTION OF THE DRAWINGS

Other objects and many of the attendant advantages of this invention will be readily appreciated as the same becomes better understood by reference to the following detailed description when considered in conjunction with the accompanying drawings, in which like reference numerals designate like parts, and wherein.

DESCRIPTION OF THE PREFERRED EMBODIMENT

Figure 1:
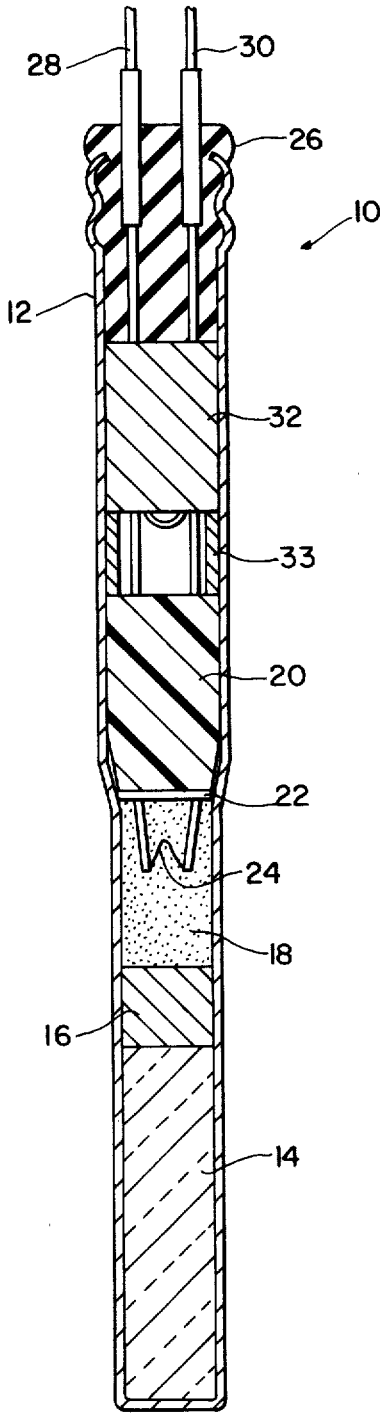
FIG. 1 is a cross-sectional view of an electroexplosive device incorporating an attenuator according to the present invention.

Referring now to the drawings, there is shown in FIG. 1 a detonator 10 formed of a cylindrical metal casing 12 having a lower portion of slightly smaller diameter than its upper portion. Although for purposes of illustration the present attenuator is applied to a detonator, it is to be understood that any electroexplosive device may be protected as disclosed herein. The lower portion of casing 12 is typically filled with, in ascending order, a base charge 14, a primer 16 such as lead azide, and an ignition mix 18. The explosive composition formed of 14, 16 and 18 is retained in the lower portion of casing 12 by a phenolic plug 20 having a tapered lower end with an insulating washer 22 mounted thereon. Two conductors passing through plug 20 project out the bottom and into ignition mix 18, to form posts for supporting a bridgewire 24 therebetween. Bridgewire 24 is a fine-gauge wire, for example nichrome, that heats up when a current is passed through it. In a typical detonator, the conductors from plug 20 would pass directly to an elastomeric seal 26 at the upper portion of casing 12, whereupon the conductors are insulated and become input leads 28 and 30. Leads 28 and 30 are coupled to a source of DC power that supplies the firing signal to detonator 10.

In an EED according to the present invention, the two conductors from plug 20 are passed through a ferrite choke core 32. As will be described below, each conductor passes 1½ times through choke 32 and is coupled to one of the input leads 28, 30, and ferrite choke 32 is held in position by a ferrule 33 spaced between the choke and phenolic plug 20. As is known in the art, ferrite is a ceramic semiconductive material formed of several metallic oxides, such as manganese zinc ferrite, nickel zinc ferrite, magnesium zinc ferrite, and others using bivalent or trivalent substitutions of copper, aluminum, cobalt, lithium and other metals. The principal requirements for the ferrite as applied to the present attenuator are that it exhibit a broad band attenuation to RF energy from broadcast to radar frequencies and that it have a high Curie temperature, preferably in excess of about 150° C. (300° F.) Ferrite choke 32 must be positioned in intimate contact with casing 12 to effectively dissipate the heat generated by choke 32 as a result of the attenuation of electromagnetic radiation. It has been found that this heat transfer means is effective for RF power levels of about 10 watts. This configuration also prevents the electromagnetic radiation from bypassing the choke and being induced into the bridgewire through a "sneak circuit".

Figure 4:
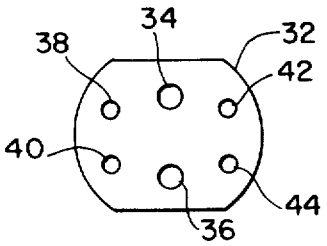
FIG. 4 is an enlarged plan view of an unwired ferrite choke.
Figure 2:
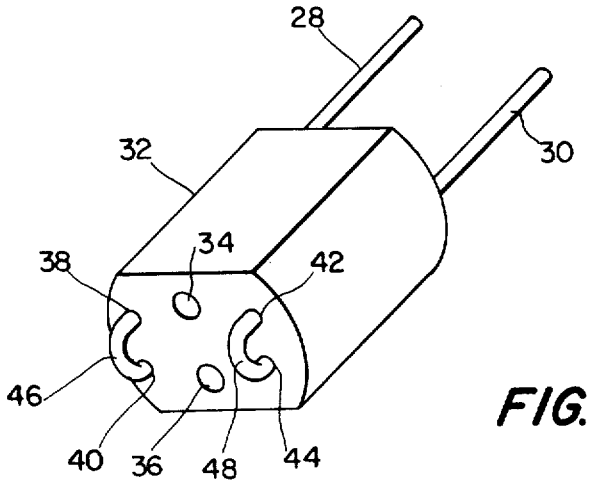
FIG. 2 is a pictorial view of the bottom portion of a partially wired ferrite choke.
Figure 3:
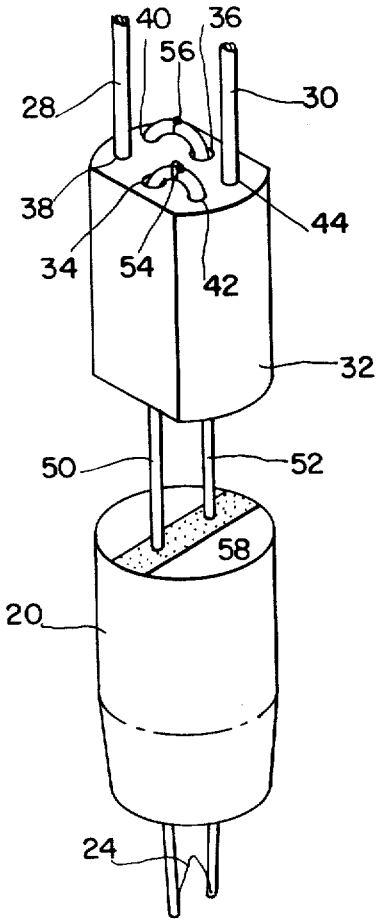
FIG. 3 is a pictorial view of the top portion of the ferrite choke of FIG. 2 showing the completed wiring thereof to a phenolic plug.

Referring now to FIG. 2, the shape of ferrite choke 32 is that of an elongated, slightly flattened cylinder. It has been found that this shape lends itself most readily to high-speed automated production techniques. As viewed from the bottom of choke 32, shown in FIG. 4, a plurality of holes (six shown) are formed in the choke, with two holes 34, 36 having a slightly larger diameter than holes 38, 40, 42 and 44. In the assembly of the attenuator, referring again to FIG. 2, a pair of U-shaped wire staples 46, 48 are inserted into holes 38, 40 and 42, 44 from the bottom of choke 32. Next, as shown in FIG. 3, the conductors 50 and 52 from plug 20 are inserted into the larger two holes 34 and 36. The larger diameters of holes 34 and 36 aid in the alignment and insertion of the conductors when the assembly of the attenuator is automated. After plug 20 and choke 32 are assembled as described above, conductor 50 (at hole 34) and one lead of wire staple 48 (at hole 42) are bent over and spot welded at junction 54. Similarly, conductor 52 (at hole 36) and one lead of staple 46 (at hole 40) are bent over and spot welded at junction 56. The other leads of wire staples 46 and 48 become input leads 28 and 30, respectively, as they exit casing 12 through seal 26. As apparent from the drawings, each input lead 28, 30 passes through ferrite choke 32 exactly 1½ times before proceeding to plug 20. This looping of the leads through the choke has an additive effect whereby absorption of electromagnetic radiation is proportionately increased. The above steps of insertion, forming and spot welding are readily performed by conventional automated machine tools, the use of which lowers the per unit cost of producing a protected EED according to the present invention.

Electrostatic protection is provided by a short section of a printed circuit tape 58, shown in FIG. 3, that electrostatically grounds the conductors 50 and 52 to casing 12 when plug 20 is inserted therein. Printed circuit tape 58 acts as a capacitor to shunt any electrostatic charge to casing 12, thus bypassing bridgewire 24.

Although the disclosed embodiment has shown the present attenuator applied to a two-wire EED, it is obvious to those skilled in the art that the attenuator is also compatible with one-wire EEDs. In the latter case, casing 12 would function as one of the bridgewire conductors. The attenuator(s), suitably modified as to configuration, may also be applied to squibs used for igniting combustible material such as ignition boosters, rocket propellants, thermite, or hot-gas generators including air-bag-restraint systems.

Thus, there has been provided by the present invention an effective electromagnetic and electrostatic attenuator that is broad band, low cost, readily adaptable to existing EEDs, which uses a minimum of components and facilitates the high-speed automated production thereof.

Obviously, many modifications and variations of the present invention are possible in the light of the above teachings. It is therefore to be understood that within the scope of the appended claims the invention may be practiced otherwise than as specifically described herein.

What is claimed and desired to be secured by Letters Patent of the United States is:

1. An electroexplosive device protected against premature initiation from electromagnetic radiation comprising:

a conductive housing having an upper portion and a closed lower portion wherein said lower portion contains an explosive train comprising an ignition mix, a primer, and a base charge;

an insulating plug contained in said housing having mounted therein a pair of conductors extending into said lower portions;

a bridgewire coupled between said pair of conductors and imedded in said ignition mix;

attenuator means formed of a lossy ferrite material contained within said housing and spaced from said insulating plug, said ferrite material having a Curie temperature greater than about 150° C. and said attenuator means being configured to receive said conductors therethrough; and nonconductive seal means mounted within the upper portion of said housing and extending therefrom, wherein said conductors pass through said seal means for coupling to a source of power for initiating said device.

2. The electroexplosive device of claim 1 wherein said attenuator means comprises:

an elongated lossy ferrite choke having a substantially cylindrical shape wherein the elongated portion of said choke is in physical contact with said housing.

3. The electroexplosive device of claim 2 wherein said ferrite choke further includes:

a plurality of pairs of holes formed therein, each of said pairs of holes configured to receive a U-shaped wire therethrough;

a single pair of holes formed into said choke in spaced relation to and having a slightly larger diameter than said plurality of pairs of holes for receiving said conductors from said insulating plug therethrough, wherein each of said conductors is coupled to a lead of one of said U-shaped wires so that each of said conductors from said insulating plug is looped through said ferrite choke a number of times proportional to the number of said plurality of pairs of holes, whereby the attenuation capacity of said ferrite choke is proportionately increased.

4. The electroexplosive device of claim 1 wherein said attenuator means comprises:

an elongated ferrite choke having two flattened and two rounded sides wherein said rounded sides are in physical contact with said housing;

a first pair of holes formed into said choke;

a second pair of holes formed into said choke and spaced from said first pair of holes;

a third pair of holes formed into said choke and spaced intermediate of said first and said second pairs of holes, said third pair of holes having a slightly larger diameter than said other two pairs, for receiving therein said conductors from said insulating plug; and a pair of U-shaped wires, one of said wires being inserted into each of said first and said second pairs of holes, wherein each of said conductors is coupled to a lead of one of said U-shaped wires so that each of said conductors from said insulating plug is looped through said ferrite choke one and one-half times, thereby increasing the electromagnetic attenuation capacity of said attenuator means.

5. The electroexplosive device of claim 1, 2, 3 or 4 further including:

capacitive tape means affixed to the end of said insulating plug opposite said bridgewire and coupled to said conductors and to said housing, whereby any electrostatic charge on said conductors is shunted to said housing and away from said bridgewire.

6. In an electroexplosive device including a metal housing and a at least one conductor coupled to an igniter, an electromagnetic radiation and electrostatic charge protection device comprising:

an electromagnetic attenuator spaced from said igniter in physical contact with said housing and configured to receive said at least one conductor therethrough, wherein said attenuator is formed of a lossy ferrite material having a Curie temperature greater than about 150° C.; and capacitive tape means coupling to said at least one conductor and to said housing wherein said tape means is mounted within said electroexplosive device intermediate of said attenuator and said igniter.

7. The electroexplosive device of claim 6 wherein said attenuator comprises:

an elongated ferrite choke having a substantially cylindrical shape wherein the elongated portion of said choke is in coupling contact with said housing:

a plurality of holes formed into said choke, each of said pairs of holes configured to receive a U-shaped wire therethrough;

a single pair of holes formed into said choke in spaced relation to and having a slightly larger diameter than said plurality of pairs of holes for receiving said conductors from said insulating plug therethrough, wherein each of said conductors is coupled to a lead of one of said U-shaped wires so that each of said conductors from said insulating plug is looped through said ferrite choke a number of times proportional to the number of said plurality of pairs of holes, whereby the electromagnetic radiation attenuation capacity of said ferrite choke is proportionately increased.

8. The electroexplosive device of claim 6 wherein said attenuator comprises:

an elongated ferrite choke having two flattened and two rounded sides wherein said rounded sides are in coupling contact with said housing;

a first pair of holes formed into said choke;

a second pair of holes formed into said choke and spaced from said first pair of holes;

a third pair of holes formed into said choke and spaced intermediate of said first and said second pairs of holes, said third pair of holes having a slightly larger diameter than said other two pairs, for receiving therein said conductors from said insulating plug; and a pair of U-shaped wires, one of said wires being inserted into each of said first and said second pairs of holes, wherein each of said conductors is coupled to a lead of one of said U-shaped wires so that each of said conductors from said insulating plug is looped through said ferrite choke one and one-half times, thereby increasing the electromagnetic attenuation capacity of said attenuator means.

* * * * *